US009846019B1

(12) United States Patent
Graf

(10) Patent No.: US 9,846,019 B1
(45) Date of Patent: Dec. 19, 2017

(54) ROCKER ARM DETONATOR

(71) Applicant: Rheinmetall Waffe Munition ARGES GmbH, Ruestorf/Schwanenstadt (AT)

(72) Inventor: Helge Graf, Schwanenstadt (AT)

(73) Assignee: Rheinmetall Waffe Munition ARGES GmbH, Ruestorf/Schwanenstadt (AT)

( * ) Notice: Subject to any disclaimer, the term of this patent is extended or adjusted under 35 U.S.C. 154(b) by 0 days.

(21) Appl. No.: 15/185,563

(22) Filed: Jun. 17, 2016

(51) Int. Cl.
*F42C 19/10* (2006.01)
*F42C 15/22* (2006.01)
*F42C 14/02* (2006.01)

(52) U.S. Cl.
CPC ..... *F42C 15/22* (2013.01); *F42C 14/02* (2013.01)

(58) Field of Classification Search
USPC ..... 102/204, 202.1, 221, 258, 275.1, 487
See application file for complete search history.

(56) References Cited

U.S. PATENT DOCUMENTS

| | | | | |
|---|---|---|---|---|
| 3,392,671 A | | 7/1968 | Hinzmann | |
| 3,498,223 A | | 3/1970 | Andersson et al. | |
| 3,554,127 A | * | 1/1971 | Becker | F42B 27/00 102/487 |
| 4,285,277 A | * | 8/1981 | Lerman | F42C 14/02 102/223 |
| 4,333,401 A | | 6/1982 | Byers et al. | |
| 5,467,713 A | * | 11/1995 | Roosmann | F42C 15/26 102/231 |
| 6,336,407 B1 | * | 1/2002 | Adimari | F42C 15/184 102/259 |
| 8,234,978 B1 | * | 8/2012 | Bond | F41A 19/07 102/275.11 |
| 8,561,540 B1 | | 10/2013 | Lauch | |
| 8,752,485 B2 | | 6/2014 | Muller et al. | |

FOREIGN PATENT DOCUMENTS

| | | |
|---|---|---|
| BE | 50 53 24 | 9/1951 |
| CH | 379 966 A | 7/1964 |
| DE | 1 289 765 B | 2/1969 |
| DE | 10 2010 021 685 B4 | 4/2012 |
| FR | 601 185 A | 1/1926 |
| FR | 625 278 A | 8/1927 |
| FR | 628 604 A | 10/1927 |
| FR | 799 440 A | 6/1936 |
| FR | 2 432 153 A1 | 2/1980 |
| FR | 2 500 621 A1 | 8/1982 |
| FR | 2 825 462 A | 12/2002 |

* cited by examiner

*Primary Examiner* — J. Woodrow Eldred
(74) *Attorney, Agent, or Firm* — Muncy, Geissler, Olds & Lowe, P.C.

(57) ABSTRACT

A rocker arm detonator is provided that includes a detonator head, which includes a pivotably arranged firing pin which is acted upon by a firing pin spring, and has a safety clip, which is pivotably disposed in the same direction of rotation as the firing pin from a starting position, in which it is pressed in the direction of the detonator head to a firing pin release position. To reliably avoid an unintentional detonation of the rocker arm detonator prior to its proper use, when the rocker arm detonator is not in use, the firing pin spring is in its untensioned state and may be tensioned by a separate tensioning lever as soon as the rocker arm detonator is to be properly deployed.

9 Claims, 4 Drawing Sheets

ROCKER ARM DETONATOR

BACKGROUND OF THE INVENTION

Field of the Invention

The invention relates to a rocker arm detonator comprising a detonator head, which includes a pivotably disposed firing pin which is acted upon by a firing pin spring, and comprising a safety clip, which is pivotably disposed in the same direction of rotation as the firing pin, from a starting position, in which it is pressed in the direction of the detonator head, into a firing pin release position.

Description of the Background Art

Rocker arm detonators of this type are known, for example, from the published examined application DE 1 289 765, which corresponds to U.S. Pat. No. 3,392,671, and are commonly used for projectiles, in particular for hand grenades. The rocker arm detonator is detonated by impelling a firing pin, which is pretensioned by a spring and which is held in the pretensioned state by the safety clip. The safety clip is mounted on one side of the detonator head and is locked in its idle position on the detonator head with the aid of a removable safety pin.

Other rocker arms are described in BE 50 53 24, FR 625 278, FR 799 440, FR 2 432 153, FR 2 500 621 and FR 601 185, which deal, in part, with a relocking mechanism. A hand grenade with delayed detonation may furthermore be found in CH 379 966 A5. FR 628 604 A describes a rocker arm detonator, a rotatable profile part engaging with the rocker arm on the side of the housing. FR 2 825 462 A1 also describes a rocker arm detonator having a detonator head, which includes a securing mechanism which permits relocking and arming. This securing mechanism includes at least one profile part, which is rotatably supported and which has an arming device as the safety device. A relocking mechanism for a rocker arm detonator is also described in DE 10 2010 021 685 B4, which corresponds to U.S. Pat. No. 8,752,485, which is incorporated herein by reference.

A disadvantage of the known rocker arm detonators is, among other things, that the firing pin spring is pretensioned even when the rocker arm detonator is not being properly used, i.e., if the hand grenade using the rocker arm detonator is not being deployed. After all, an unwanted activation of the detonator (for example, by unintentionally pulling the safety pin) is greatly promoted thereby.

SUMMARY OF THE INVENTION

It is therefore an object of the invention to provide a rocker arm detonator, in which an unintentional detonation prior to its proper use is reliably avoided.

In an exemplary embodiment, the firing pin spring of a rocker arm detonator which is not in use should be in its untensioned state and be tensionable by a separate tensioning lever as soon as the projectile containing the rocker arm detonator is being properly deployed (unstored energy fuse head).

For this purpose, on the detonator head of the rocker arm detonator, the tensioning lever, which is actuatable from an idle position into an armed position, is connected to the firing pin spring via a tensioning lever shaft in such a way that, only when the safety clip is in its starting position is the firing pin spring actuatable from its untensioned state into its tensioned state and the firing pin spring is lockable in its tensioned state with the aid of a securing mechanism.

Since the firing pin spring is in its slackened state when the rocker arm detonator is not in use, a safety pin may be advantageously dispensed with in the rocker arm detonator according to the invention.

To ensure that the firing pin spring is able to be tensioned only when the safety clip is in its starting position, it has proven to be advantageous if the safety clip has a cam, which engages with a guide groove of the tensioning lever in such a way that the tensioning lever is actuatable into its armed position only when the safety clip is being held in its starting position, and the guide groove releases the cam in the armed position of the tensioning lever, so that the safety clip may be pivoted into the firing pin release position.

The firing pin spring may be, for example, a torsion spring, guided by the tensioning lever shaft, whose first leg is connected to the tensioning lever shaft and whose second leg is connected to the firing pin.

The securing mechanism for securing the firing pin spring in its tensioned position can includes a disk-shaped locking wheel, which is rotatably fixedly connected to the tensioning lever shaft and which contains at least one first engagement groove on its outer circumference, and includes a locking arm, which is pivotably arranged around a rotation axis, the rotation axis of the locking arm being disposed in parallel to the tensioning lever shaft, and the locking arm having an engaging element on its end facing away from the rotation axis, which is pressed against the outer circumference of the locking wheel by a pretensioned spring, so that the engaging element engages with the second engagement groove of the locking wheel when the tensioning lever reaches the armed position—and the firing pin spring is thus in the tensioned state.

A first engagement groove can be disposed on the outer circumference of the locking wheel in such a way that the engaging element of the locking arm engages with the first engagement groove of the locking wheel in the idle position of the tensioning lever, and the tensioning lever is secured thereby in the idle position.

To easily slacken the tensioned firing pin spring again when a deployment of the corresponding projectile is no longer intended, it has proven to be advantageous if the securing mechanism may be released by an externally actuatable tension releasing element, so that, when the safety clip is in its starting position, the firing pin spring transitions from its tensioned state back to its untensioned state upon actuation of the tension releasing element.

The tension releasing element may be a pressure or sliding element, which, when actuated, acts upon the end of the locking arm facing away from the rotation axis in such a way that the engaging element of the locking arm moves out of the engagement groove of the locking wheel, and the tensioning lever is pivoted from its armed position back to its idle position by the pressure of the firing pin spring.

To be able to release the tension releasing element with the throwing hand holding the safety clip in its starting position, it has proven to be advantageous to dispose the tension releasing element in a externally actuatable manner by means of a recess of the safety clip.

To thus reliably avoid an unintentional detonation of the rocker arm detonator prior to its proper use, it is provided that, when the rocker arm detonator is not in use, the firing pin spring is in its untensioned state and may be tensioned by a separate tensioning lever as soon as the rocker arm detonator is to be properly used.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
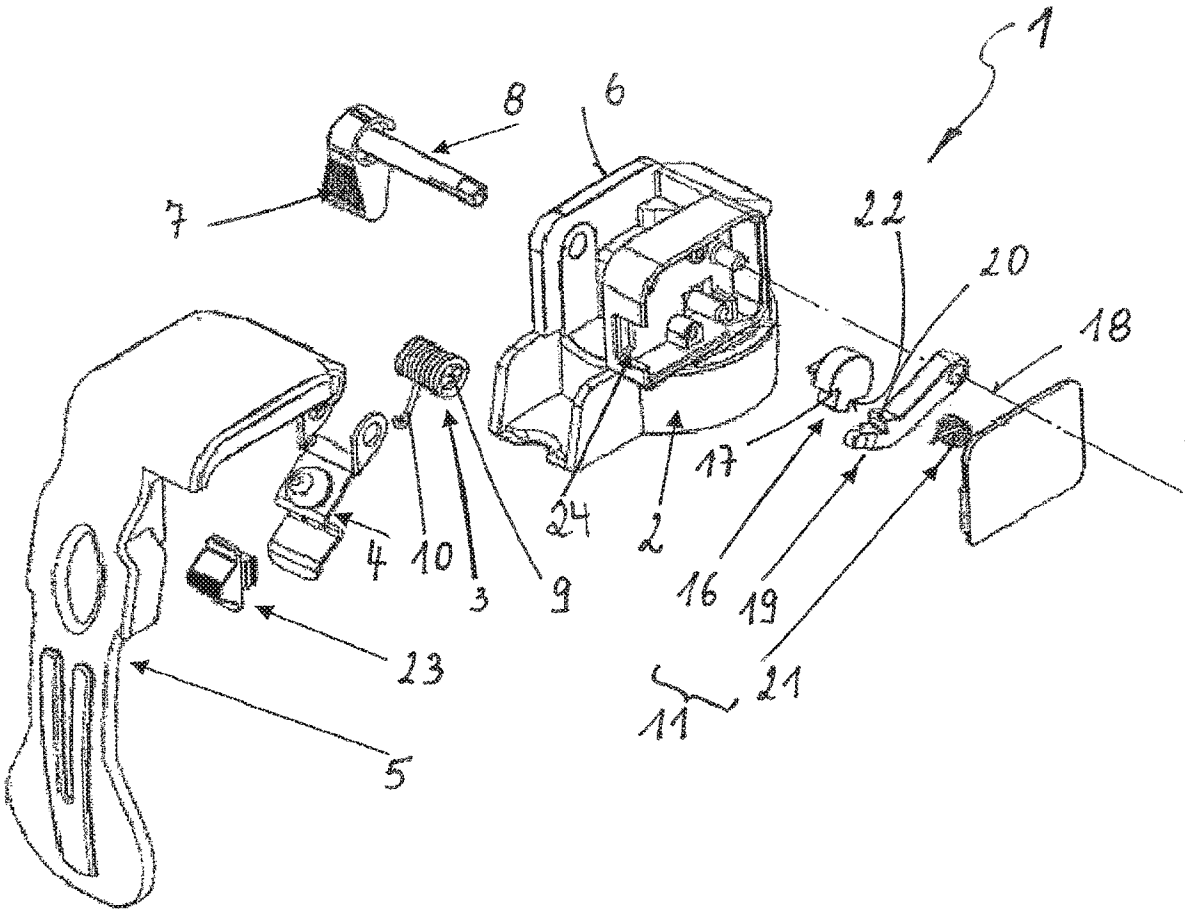
FIG. 1 shows an exploded view of a rocker arm detonator according to an exemplary embodiment of the invention, including a safety clip and tensioning lever.
Figure 5:
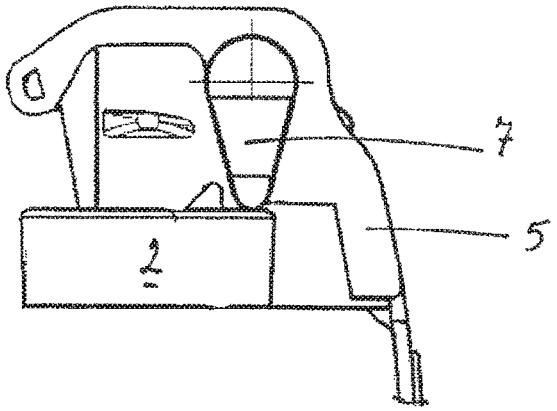
FIGS. 5 and 6 show side views of the rocker arm detonator illustrated in FIG. 1, the firing pin spring being in its slackened state.
Figure 6:
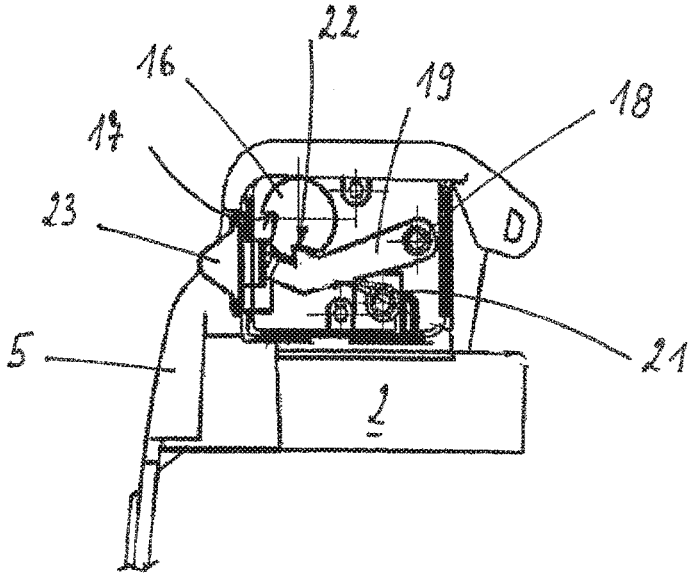
Figure 8:
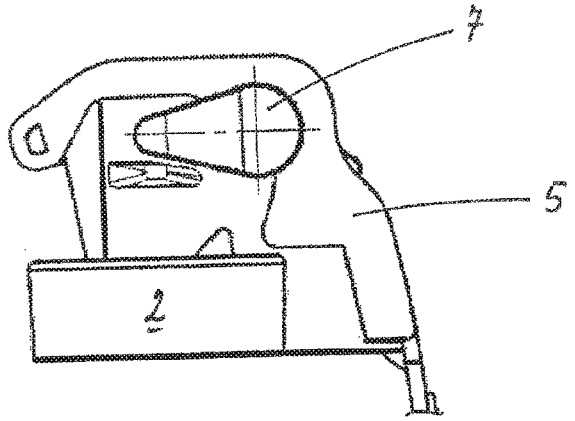
FIGS. 8 to 10 show views corresponding to FIGS. 5 to 7, the firing pin spring being in its tensioned state.
Figure 9:
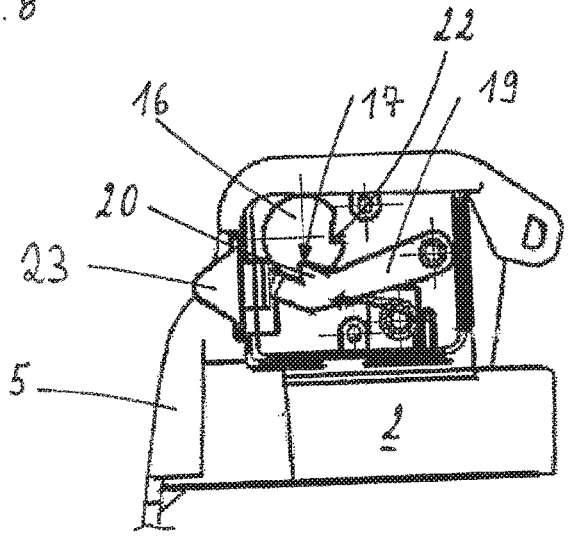

In FIG. 1, a rocker arm detonator according to the invention for a hand grenade, illustrated in an exploded view, is designated by reference numeral 1. Rocker arm detonator 1 contains a detonator head 2. The latter includes a pivotably arranged firing pin 4, which is acted upon by a firing pin spring 3, and a safety clip 5 (i.e., safety lever), on which firing pin 4 is supported. Safety clip 5 is pivotably disposed in the same direction of rotation as firing pin 4 from a starting position, in which it is pressed, for example manually, in the direction of detonator head 2 (also see FIGS. 5 and 6 as well as FIGS. 8 and 9), into a firing pin release position (not illustrated).

According to the invention, it is now provided that firing pin spring 3 is not tensioned when the corresponding hand grenade is not being used, i.e., firing pin 4 in this case is supported on safety clip 5 without pretensioning.

Figure 7:
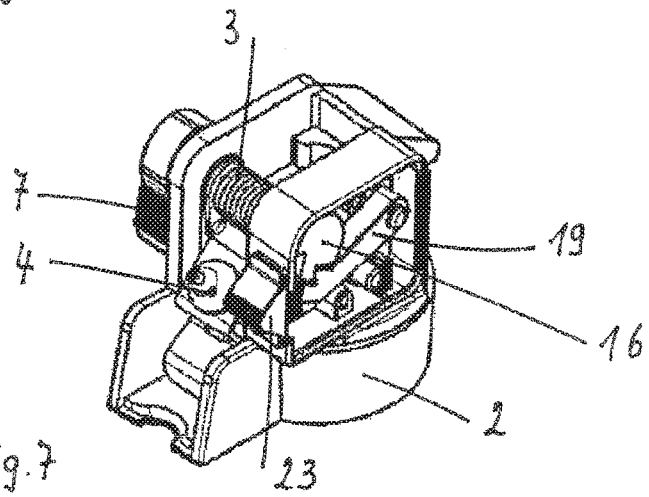
FIG. 7 shows a perspective view of the rocker arm detonator illustrated in FIG. 1, including a slackened firing pin spring and omitting the safety clip.
Figure 10:
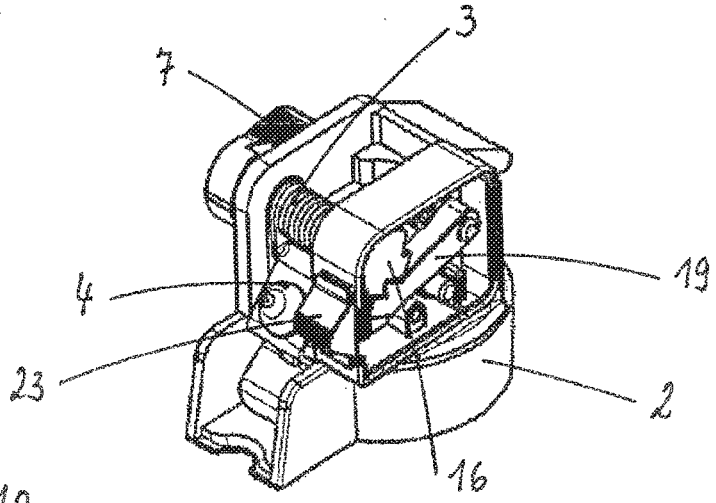

Instead, firing pin spring 3 is only tensioned when the hand grenade supporting rocker arm detonator 1 is to be deployed. For this purpose, a tensioning lever 7, which is pivotable from an idle position (FIGS. 5 through 7) into an armed position (FIGS. 8 through 10), is disposed on left outer side 6 of detonator head 2 and is rotatably fixedly connected to a tensioning lever shaft 8 supported in detonator head 2. Firing pin spring 3, which is designed as a cylindrical coil spring (torsion spring) and whose first leg 9 is connected to tensioning lever shaft 8 and whose second leg 10 is connected to firing pin 4, is disposed on this tensioning lever shaft 8, so that a rotation of tensioning lever 7 causes a rotation of tensioning lever shaft 8 and thus a tensioning of firing pin spring 3.

However, it is absolutely necessary for safety clip 5 to remain pressed for the purpose of tensioning firing pin spring 3. Otherwise, firing pin 4, and thus also safety clip 5, would be pivoted in the direction of a projection 14 and be locked upon actuation of tensioning lever 7 from its idle position to its armed position via firing pin spring 3, and firing pin spring 3 would not be tensionable to the pretension required for the detonation operation.

As soon as tensioning lever 7 is pivoted into its armed position while safety clip 5 is being pressed, firing pin spring 3 is secured in this position with the aid of a securing mechanism 11, so that, when tensioning lever 7 is released, firing pin spring 3 does not automatically return to its slackened state by the back-rotation of tensioning lever shaft 8.

Figure 2:
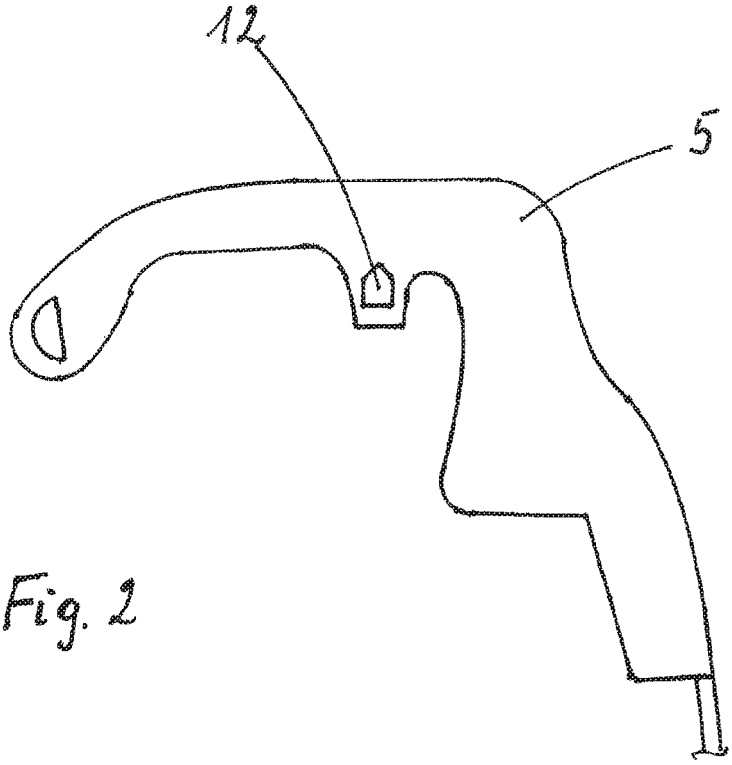
FIG. 2 shows a side view of the safety clip of the rocker arm detonator illustrated in FIG. 1, from the direction designated by II in FIG. 1.
Figure 3:
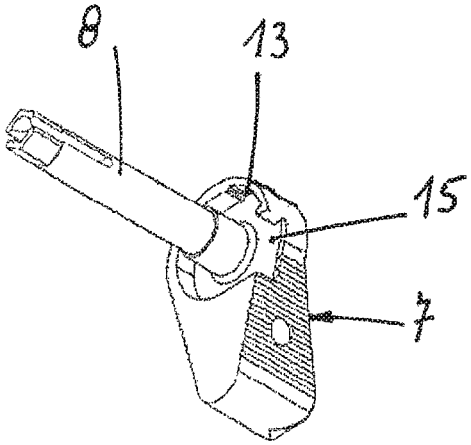
FIG. 3 shows a perspective view of the tensioning lever of the rocker arm detonator illustrated in FIG. 1.
Figure 4:
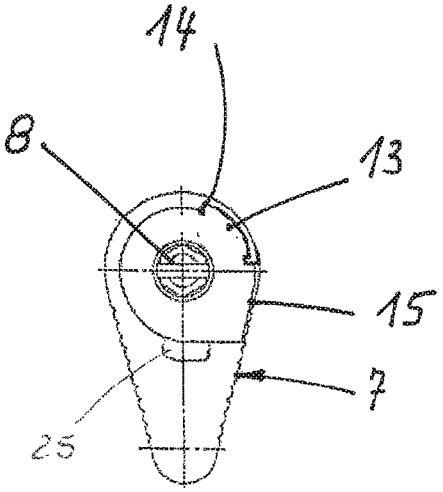
FIG. 4 shows a top view of the tensioning lever illustrated in FIG. 3.

To additionally ensure that an impelling of firing pin 4 is possible only when firing pin spring 3 has a sufficiently high tension for the detonation operation, and tensioning lever 7 is thus already in the armed position, safety clip 5 supports a cam 12 (FIG. 2), which engages with an engagement groove 13 of tensioning lever 7 (FIGS. 3 and 4). This engagement groove 13 has a first projection 14 and a second projection 25 which ensures that tensioning lever 7 is actuatable into its armed position only when safety clip 5 is also being held in its starting position. Otherwise, cam 12 of safety clip 5 would block the movement of tensioning lever 7 after a short pivoting action of tensioning lever 7.

After projection 14 is overcome by pressing safety clip 5, tensioning lever 7 may continue to pivot and engages with its armed position when safety clip 5 is (again) under too low a pressure and after overcoming second projection 25, and upon reaching the armed position, the tensioning lever releases cam 12 of safety clip 5 by means of a corresponding recess 15 on its edge, so that safety clip 5 is pivotable into the firing pin release position (as soon as the hand of the hand grenade user releases the safety clip).

Securing mechanism 11 includes a disk-shaped locking wheel 16 which is rotatably fixedly connected to tensioning lever shaft 8 and which contains a second engagement groove 17 on its outer circumference, and includes a locking arm 19, which is pivotably arranged around a rotation axis 18. Rotation axis 18 of locking arm 19 is disposed in parallel to tensioning lever shaft 8, and locking arm 19 has an engaging element 20 on its end facing away from rotation axis 18. This engaging element 20 is pressed against the outer circumference of locking wheel 16 by a pretensioned spring 21, so that, when tensioning lever 7 reaches the armed position—and firing pin spring 3 is thus in the tensioned state—engaging element 20 engages with second engagement groove 17 of locking wheel 16.

As is apparent in FIGS. 1, 6, 7, 9 and 10, a first engagement groove 22 is disposed on the outer circumference of locking wheel 16 in such a way that engaging element 20 of locking arm 19 engages with second engagement groove 17 of locking wheel 16 in the idle position of tensioning lever 7, and tensioning lever 7 is secured thereby in its idle position.

To ensure that an already tensioned firing pin spring 3 (FIGS. 8 through 10) may be easily slackened again without risking a detonation of the corresponding hand grenade, rocker arm detonator 1 includes a tension releasing element 23. It is actuatable from the outside by means of a recess 24 of safety clip 5 and acts upon the end of locking arm 19 facing away from rotation axis 18.

If tension releasing element 23 is, for example, pushed downward in the exemplary embodiment described here, engaging element 20 of locking arm 19 disengages from second engagement groove 17 of locking wheel 16, and tensioning lever 7 is pivoted back into its starting position by the pressure of firing pin spring 3.

The invention is, of course, not limited to the exemplary embodiment described above. For example, a leaf spring, which is tensioned by a corresponding cam disposed on the tensioning lever shaft, may be used instead of a torsion spring as the firing pin spring.

For example, a pressure element, which presses the locking arm out of the engagement groove of the locking wheel, may be used instead of a sliding element as the tension releasing element.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A rocker arm detonator comprising:

a detonator head that includes a pivotably disposed firing pin that is acted upon by a firing pin spring;

a safety lever pivotably disposed between a starting position and a firing pin release position, the firing pin being supported on the safety lever, wherein the detonator head includes a tensioning lever, which is actuatable from an idle position to an armed position and which is connected to the firing pin spring via a tensioning lever shaft such that the firing pin spring is actuatable from an untensioned state to a tensioned state, and wherein the firing pin spring is locked in the tensioned state by a securing mechanism only when the safety lever is in the starting position.

2. The rocker arm detonator according to claim 1, wherein the safety lever supports a cam, which engages with a guide groove of the tensioning lever such that the tensioning lever is actuatable into the armed position only when the safety lever is being held in the starting position, and wherein the tensioning lever releases the cam upon reaching the armed position, so that the safety lever is pivotable into the firing pin release position.

3. The rocker arm detonator according to claim 1, wherein the firing pin spring is a torsion spring guided by the tensioning lever shaft whose first leg is connected to the tensioning lever shaft and whose second leg is connected to the firing pin.

4. The rocker arm detonator according to claim 1, wherein the securing mechanism includes a disk-shaped locking wheel, which is rotatably fixedly connected to the tensioning lever shaft and which contains at least one first engagement groove on an outer circumference thereof, and includes a locking arm, which is pivotably arranged around a rotation axis, the rotation axis of the locking arm being disposed in parallel to the tensioning lever shaft, and the locking arm having an engaging element on an end facing away from the rotation axis, which is pressed against the outer circumference of the locking wheel by a pretensioned spring, so that the engaging element engages with a second engagement groove of the locking wheel when the tensioning lever reaches the armed position and the firing pin spring is thus in the tensioned state.

5. The rocker arm detonator according to claim 4, wherein the at least one first engagement groove is disposed on the outer circumference of the locking wheel such that the engaging element of the locking arm engages with the at least one first engagement groove of the locking wheel in the idle position of tensioning lever, and the tensioning lever is secured thereby in the idle position.

6. The rocker arm detonator according to claim 4, wherein the securing mechanism is releasable by an externally actuatable tension releasing element, so that the firing pin spring transitions from the tensioned state back to the untensioned state when the safety lever is in the firing pin release position and the tension releasing element is actuated.

7. The rocker arm detonator according to claim 6, wherein the tension releasing element is a pressure or sliding element, which, upon actuation, acts upon the end of the locking arm facing away from the rotation axis such that the engaging element of the locking arm disengages from the second engagement groove of the locking wheel, and the tensioning lever is pivoted back into the idle position by the pressure of the firing pin spring.

8. The rocker arm detonator according to claim 6, wherein the tension releasing element is disposed in such a way that it is actuatable from the outside via a recess of the safety lever.

9. The rocker arm detonator according to claim 1, wherein the safety lever is pivoted in the same direction of rotation as the firing pin from the starting position, in which it is pressed in the direction of the detonator head, into the firing pin release position.

* * * * *